United States Patent [19]

Anderson, deceased

[11] Patent Number: 4,671,045

[45] Date of Patent: Jun. 9, 1987

[54] METHOD AND ASSEMBLY FOR SEALING ARTICLES

[75] Inventor: Andrew W. Anderson, deceased, late of West Caldwell, N.J., by Miriam Anderson, Executrix

[73] Assignee: Scandia Packaging Machinery Company, Clifton, N.J.

[21] Appl. No.: 516,394

[22] Filed: Jul. 22, 1983

[51] Int. Cl.[4] ..... B65B 51/10

[52] U.S. Cl. ..... 53/463; 53/477; 53/375; 53/388

[58] Field of Search ..... 53/375, 379, 387, 388, 53/463, 476, 477, 373; 156/359, 583.1, 583.5, 555

[56] References Cited

U.S. PATENT DOCUMENTS

| | | | |
|---|---|---|---|
| 2,133,339 | 10/1938 | Baxter | 53/388 |
| 2,420,763 | 5/1947 | Wells | 53/388 |
| 2,563,858 | 8/1951 | McGinley et al. | 53/388 |
| 3,114,226 | 12/1963 | Taggert et al. | 53/375 |
| 3,164,938 | 1/1965 | Waite | 53/388 X |
| 3,335,544 | 8/1967 | Baker et al. | 53/375 |
| 3,347,014 | 10/1967 | Mosse | 53/375 X |
| 3,431,398 | 3/1969 | Gunter Wahle . | |
| 3,692,611 | 9/1972 | Kuhnle . | |
| 3,763,629 | 10/1973 | Carlstrom et al. . | |
| 3,829,338 | 8/1974 | Hayasi et al. | 156/359 X |
| 3,861,983 | 1/1972 | Harrell . | |
| 3,979,881 | 9/1976 | Seragnoli . | |
| 3,984,963 | 10/1976 | Seragnoli . | |
| 4,220,847 | 9/1980 | Focke et al. | 53/388 X |

*Primary Examiner*—Robert L. Spruill
*Assistant Examiner*—Steven P. Weihrouch
*Attorney, Agent, or Firm*—Neil F. Markva

[57] ABSTRACT

A method and assembly for sealing articles incorporates a continuously moving transfer mechanism which receives the articles from an intermittent feed and feeds them to an intermittent sealing mechanism. The intermittent sealing mechanism uses an elongate sealing member or heater plate which extends over a substantial portion of the sealing mechanism. The sealing member has a plurality of separate heaters functionally associated with the plate to apply heat to the articles at a plurality of stations during dwell times while the articles move through the sealing mechanism. The sealing member or heater plate reciprocates into and out of contact with the articles during the dwell periods by a cam to effect simultaneous sealing action at the plurality of stations.

9 Claims, 6 Drawing Figures

METHOD AND ASSEMBLY FOR SEALING ARTICLES

BACKGROUND OF THE INVENTION

This invention relates to a method and apparatus for sealing articles. More particularly, the invention is used in package wrapping machines to seal heat sealable material such as thermoplastic overwrap to previously wrapped packages.

Articles such as food and tobacco products are commonly overwrapped with a transparent material to seal the packages as quickly as possible after the packages are manufactured. Typically, the overwrap material comprises a thermoplastic material which fuses upon application of heat. Various types of machines have been designed to apply and seal the overwrap, including machines wherein a heated plate is in position to be "wiped" with the part of the overwrap which is to be fused and sealed as the package is moved along a path adjacent the heated plate. Other packaging machines are intermittent thereby causing the package to pause in its movement while the heated plate is brought into contact therewith. An example of the latter type machine is in U.S. Pat. No. 3,979,881.

One of the desirable materials for use as the overwrapping material is "Hercules", marketed by Hercules, Inc. of Wilmington, Delaware. However, this material requires a fairly accurate regulation of the temperature of the heated plate, i.e. in the range of 125°-165° C. Accurate control of the temperature applied to the overwrap is not easily accomplished with those machines which "wipe" the overwrap with the heated plate, and uneven sealing and burning of the leading portion of the sealed area may result. In those machines exemplified by the aforementioned patents, accurate control of the temperature, package contact time and pressure is required to obtain a good seal and avoid burning or uneven sealing. The sealing function is accomplished by pressing a heated plate one time against the package. Under high speed operation, relatively higher temperatures must be used with corresponding shorter contact time. This may result in non-uniform operation and unsatisfactory seals along the seams of the overwrap.

Other typical prior art machines are exemplified in U.S. Pat. Nos. 3,984,963, 3,431,398, 3,692,611, 3,763,629 and 3,961,983.

PURPOSE OF THE INVENTION

The primary object of this invention is to provide a sealing assembly in a wrapping machine wherein heat is applied to fuse and seal a sheet of heat sealable material to a package, with the fusing and sealing function being carried out in multiple steps.

Another object of this invention is to provide an intermittent type thermal sealing assembly in a wrapping machine wherein the articles or packages being overwrapped intermittently move through the assembly. Heat is repeatedly applied to a seam of the overwrap to fuse and seal it while the package is stationary.

A further object of this invention is to provide a sealing assembly in a wrapping machine including reciprocating heated plates which extend over a substantial portion of the sealing assembly and contact a package a plurality of times during passage of the package through the assembly. The elongated heated plates remain in sufficient proximity with the package during its passage through the assembly to constantly apply heat to the package while it moves through the sealing assembly.

Yet another object of this invention is to provide an assembly for sealing heat sealable material to packages which are intermittently fed through a flat turret type sealing assembly and are transferred by a continuously moving transfer assembly to a further intermittently operated sealing assembly.

An even further object of the invention is to provide a method of sealing a heat sealable material to a package, wherein the package is transferred by a continuously moving transfer assembly from an intermittently operated first sealing assembly to an intermittently operated second sealing assembly.

A still further object of the invention is to provide a method of applying heat sealable material to a package and sealing it by applying heat a multiple number of times while the package is stationary at a plurality of work stations.

SUMMARY OF THE INVENTION

These and other objects of the invention are accomplished through the method and apparatus for sealing overwrap to articles as described herein. Articles or packages, such as cigarette packages, are overwrapped in a conventional machine having a conveying means for supporting and intermittently moving packages along a path through a plurality of stationary work stations. A seam or overlap of the overwrap occurs at a side of the package. The overlapped portion or seam at the side of the package is sealed in a known machine such as a flat turret machine. The package is then transferred by a continuously moving transfer assembly to an intermittently operated sealing assembly.

The heat sealing means includes at least one elongate heater plate extending along a side of the conveying means and extending in a parallel to the path assembly over a substantial portion of its length. The plate reciprocates into contact with a further side of the package on which there is another seam. The packages dwell for a period at each of a plurality of stationary work stations during their passage through the assembly. A plurality of packages have heat applied thereto simultaneously. Moreover, each package has heat applied thereto a multiple number of times. The plates remain in sufficient proximity with the packages during the time the packages are moving therebetween, to constantly apply heat to the package. Additionally, the normal spacing between the plates may be adjusted to accommodate packages of different sizes.

For larger sized packages, additional pressure may be applied while heat sealing a seam along the side of a package. The heating means may include shaped projections at spaced locations along the heater plate at the work stations. The shaped projections are effective to press inwardly against defined portions of the sides of the packages to enhance the sealing efficient at each work station.

BRIEF DESCRIPTION OF THE DRAWINGS

Other objects of this invention will appear in the following description and appended claims, reference being made to the accompanying drawings forming a part of the specification, wherein like reference characters designate corresponding parts in several views.

DETAILED DESCRIPTION

Figure 1:
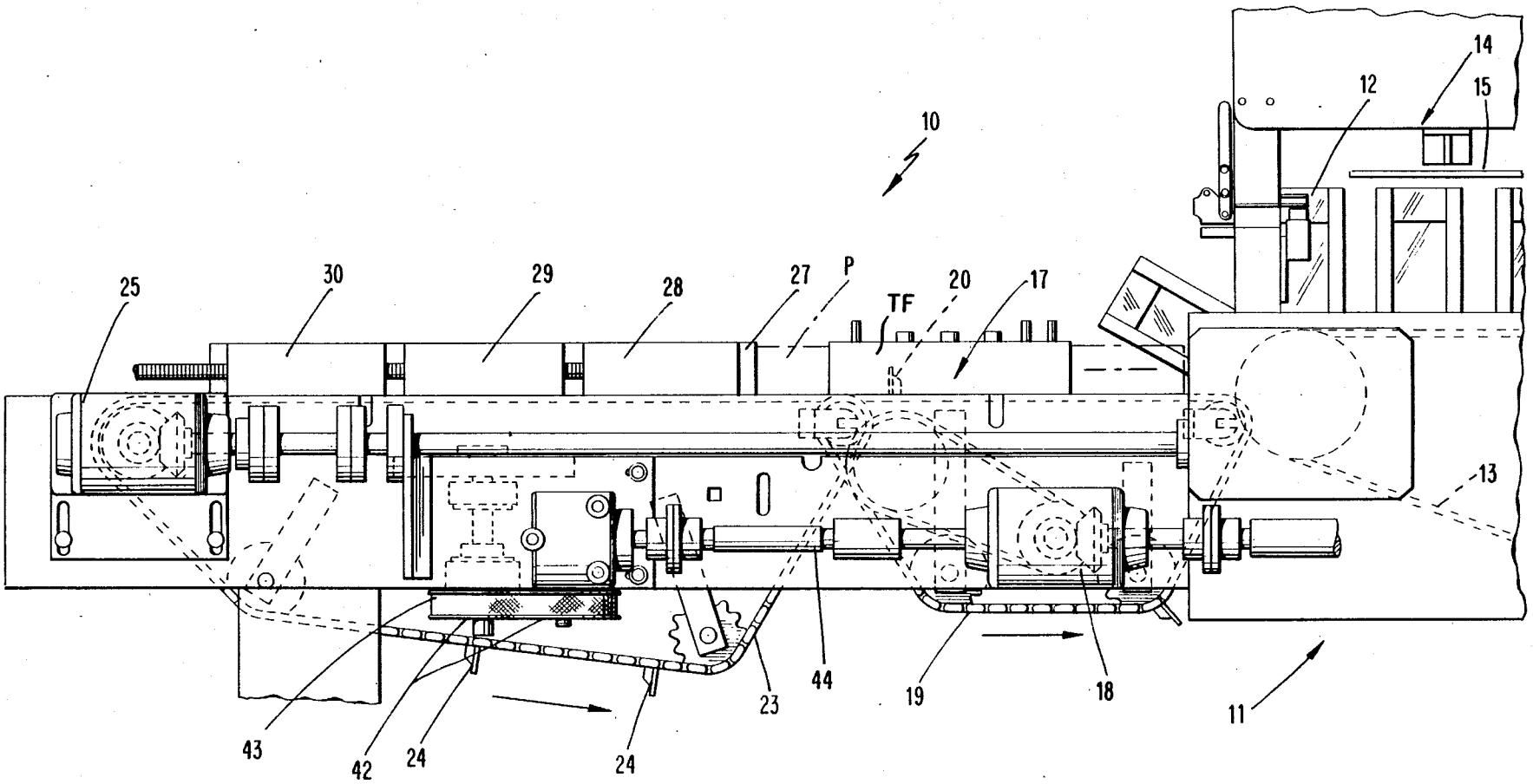
FIG. 1 is a side elevational view of a sealing assembly made in accordance with this invention.
Figure 2:
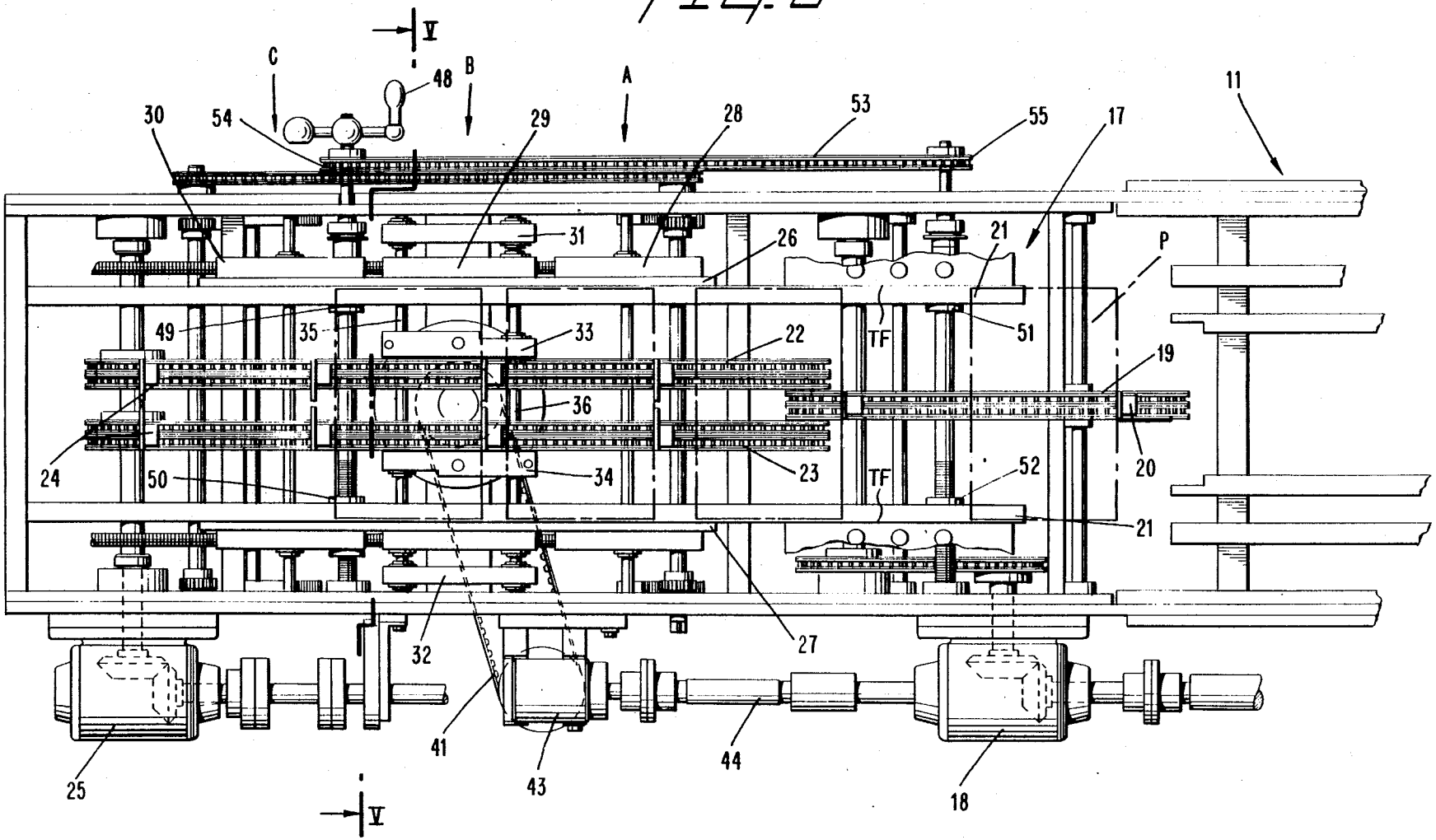
FIG. 2 is a top plan view of the sealing assembly of the invention shown in combination with the transfer assembly and the flat turret sealing assembly.
Figure 4:
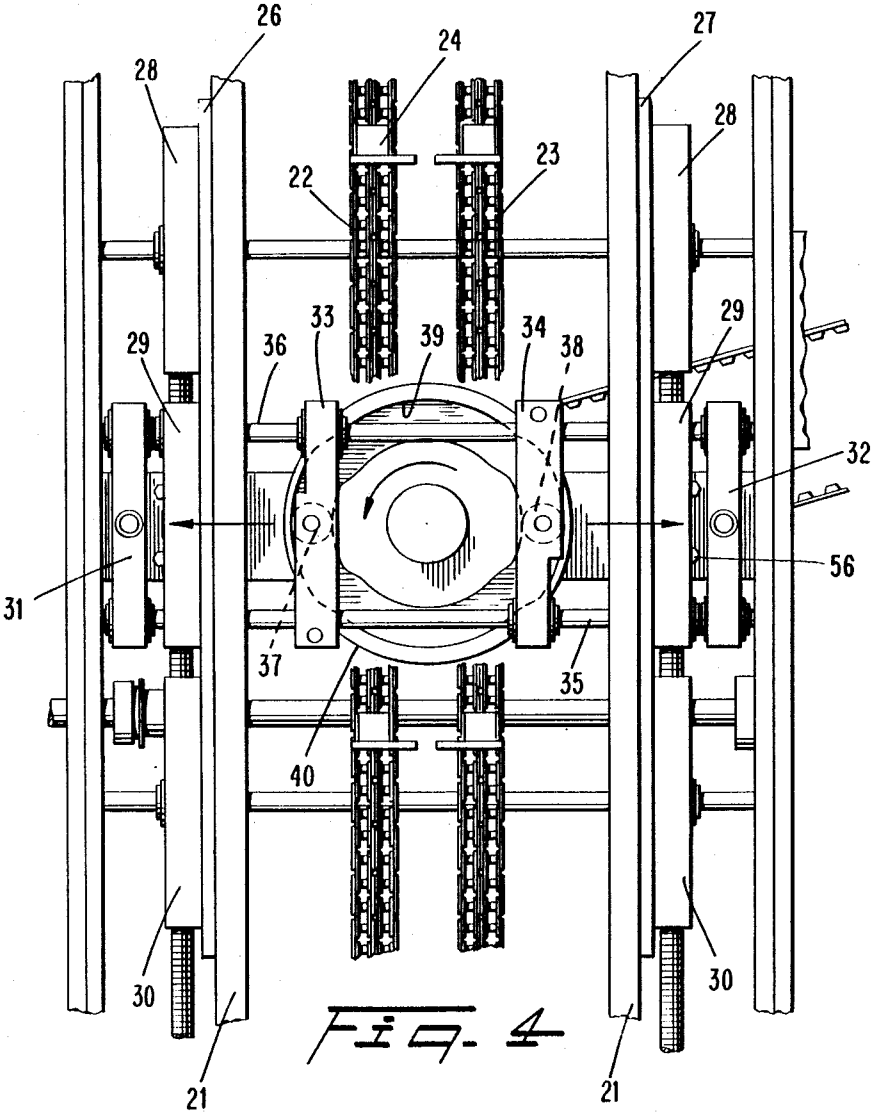
FIGS. 3 and 4 are fragmentary top plan views showing the inward and outward operating positions of the sealing assembly of the invention.
Figure 3:
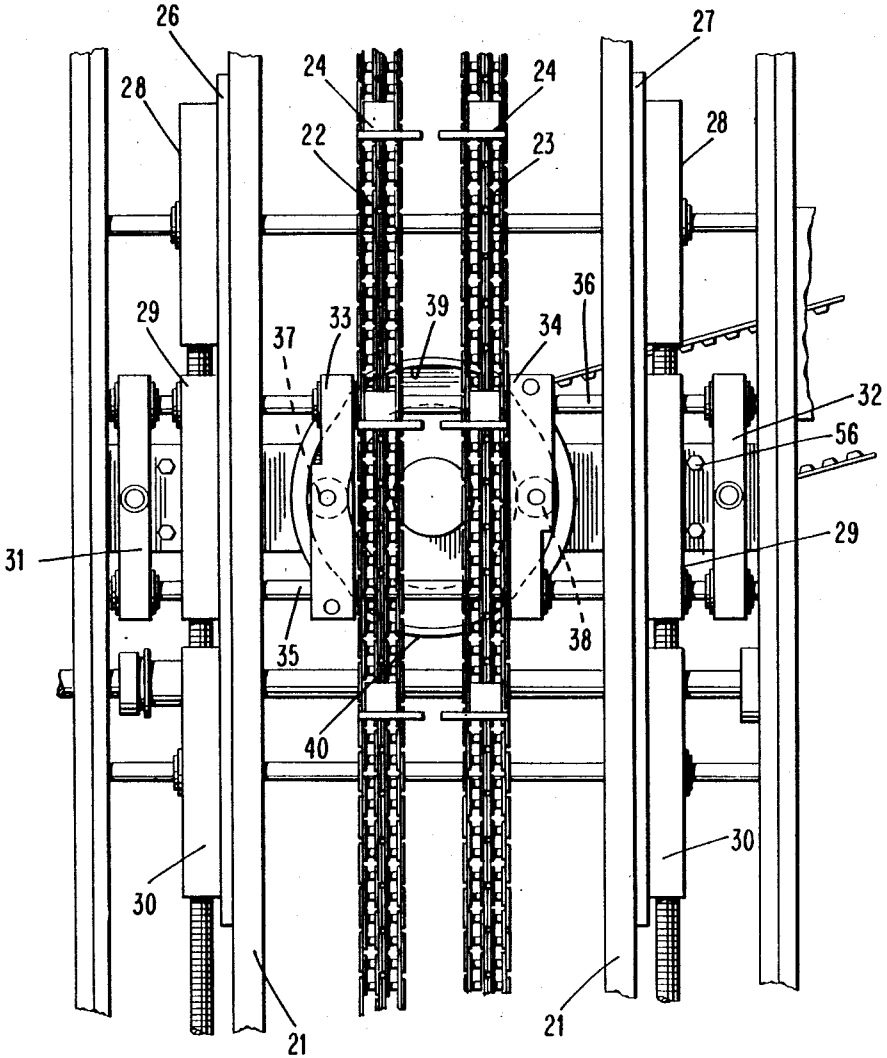
Figure 5:
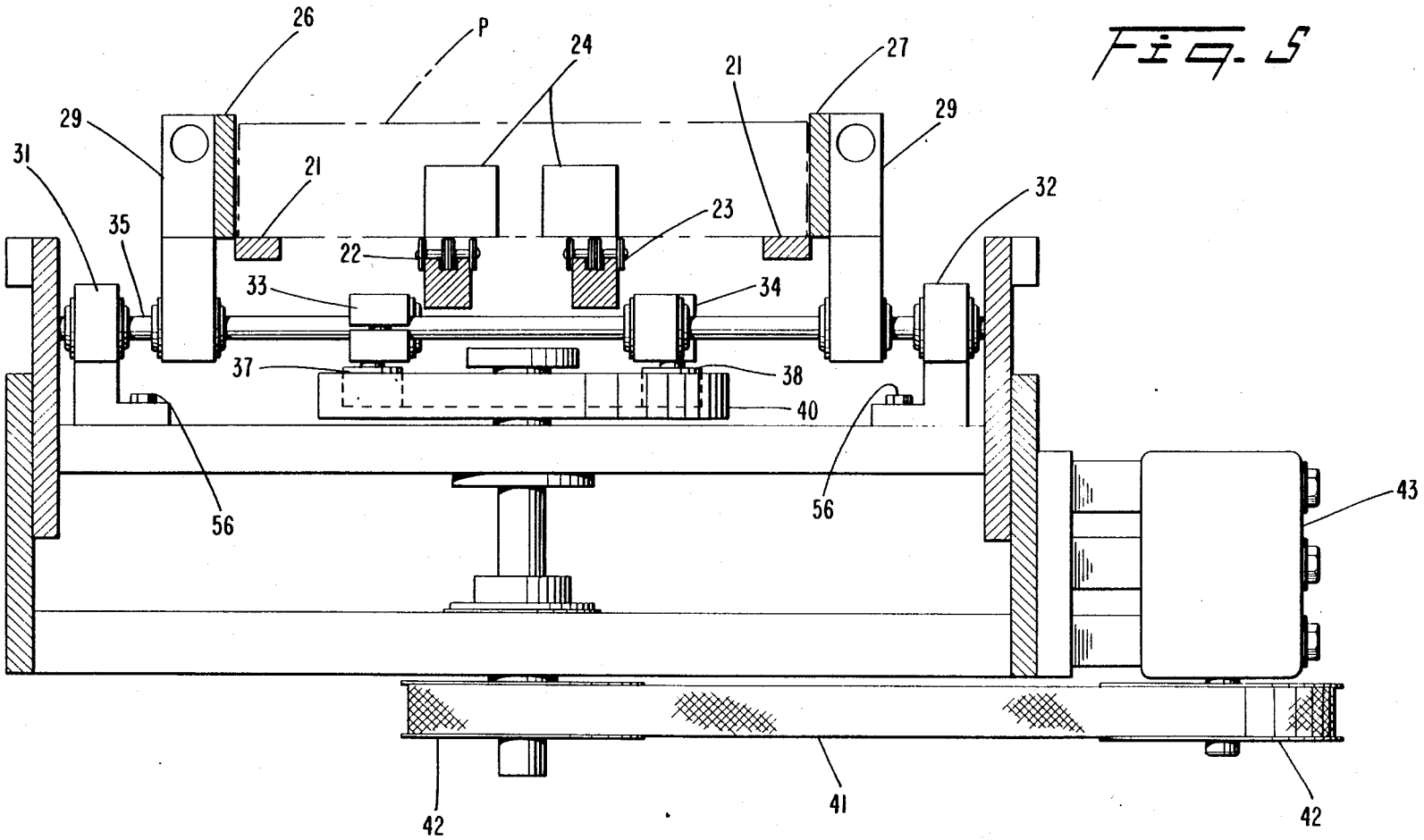
FIG. 5 is a sectional view of the sealing assembly taken along line V—V of FIG. 2.

More specifically, the assembly, generally designated 10, is used to effect a method of sealing a heat sealabe material on articles or packages P. Assembly 10 is part of an overwrapping machine which includes an intermittently driven flat turret machine 11 of the type shown in U.S. Pat. No. 3,877,203 incorporated herein by reference. A plurality of package engaging pushers or pockets 12 carried by endless chains 13 convey packages P past a heater 14 mounted in plate 15. The packages are advanced intermittently by a suitable drive 16, such as a Geneva mechanism or the like. When the packages pause, heater 14 is brought into contact with each package to seal the overwrap at the side of the package.

Packages P are delivered by flat turret machine 11 to a continuously moving transfer assembly 17 operated by a suitable drive means or gearing 18. An endless chain 19 carries a plurality of pushers 20 which engage packages P and convey them toward sealing assembly 10. The opposite ends of packages P rest on rails or tracks 21 while being conveyed by pushers 20. As shown, the relationship of the flat turret machine 11 and the transfer assembly is such that the packages are reoriented 90° from their edgewise disposition in flat turret machine 11 to a flatwise disposition in transfer assembly 17.

The rails or tracks 21 extend from the transfer assembly throughout the length of the sealing assembly 10. A pair of endless chains 22 and 23 extend alongside tracks 21 and carry a plurality of pushers 24 which engage packages P delivered from transfer assembly 17. The ends of the overwrap material is tucked and folded in a known manner using the known mechanism TF. In one particular embodiment of the invention, ten (10) pushers are laterally spaced at 8 inches. Chains 22 and 23 are intermittently driven by a suitable drive 25, such as a Geneva mechanism or the like. Thus, packages P are advanced continuously through the tucker folder mechanism TF and in intermittent steps through sealing assembly 10 with several pauses or dwell periods during which packages P are stationary.

A pair of heater plates 26 and 27 extend alongside tracks 21 over a substantial portion of the length of the sealing assembly 10. Three separate heater devices 28, 29 and 30 are mounted on the side of heater plates 26 and 27 oppositely disposed with respect to each other along tracks 21. The heater plates 26 and 27 and heater devices 28, 39 and 30 are carried on mounting brackets 31 and 32 which are fixed at one end to slide members 33 and 34. Members 33 and 34 are slidably mounted on a pair of parallel, spaced apart guide rods 35 and 36 extending transversely of sealing assembly 10.

Cam followers 37 and 38 project downwardly from the underside of slide members 33 and 34, respectively, and into a cam track or groove 39 of a rotatable cam member 40. Suitable driven means such as belt and pulley arrangement 41 and 42 and including gearing 43 connected with drive shaft 44 drives cam member 40. Thus, as cam 40 rotates, slide members 33 and 34 move in and out on guide rods 35 and 36 thereby carrying heater plates 26 and 27 into and out of contact with packages P.

Movement of heater plates 26 and 27 is correlated with movement of packages P. Thus, heater plates 26 and 27 move into contact with packages P which are halted at each of the three work stations A, B and C, corresponding to the location of the three heater devices 28, 29 and 30. Accordingly, heat is applied at three different times to packages P while moving through assembly 10. Moreover, the spacing of heater plates 26 and 27 from the ends of packages P is sufficient to allow unhindered movement of packages P while maintaining a proximity effective for applying a substantially elevated temperature to the heat sealable material the entire time packages P are moving through sealing assembly 10. In this embodiment, the plates 26 and 27 move back and forth a distance of about one-eighth inch (1/8").

Thus, the sealing time is substantially longer than with prior art devices and lower heating temperatures can be used. Greater pressure is applied by heater plates 26 and 27 when packages P are standing still compared to pressure which may be applied while they are moving. The result is a more uniform, stronger seal.

Figure 6:
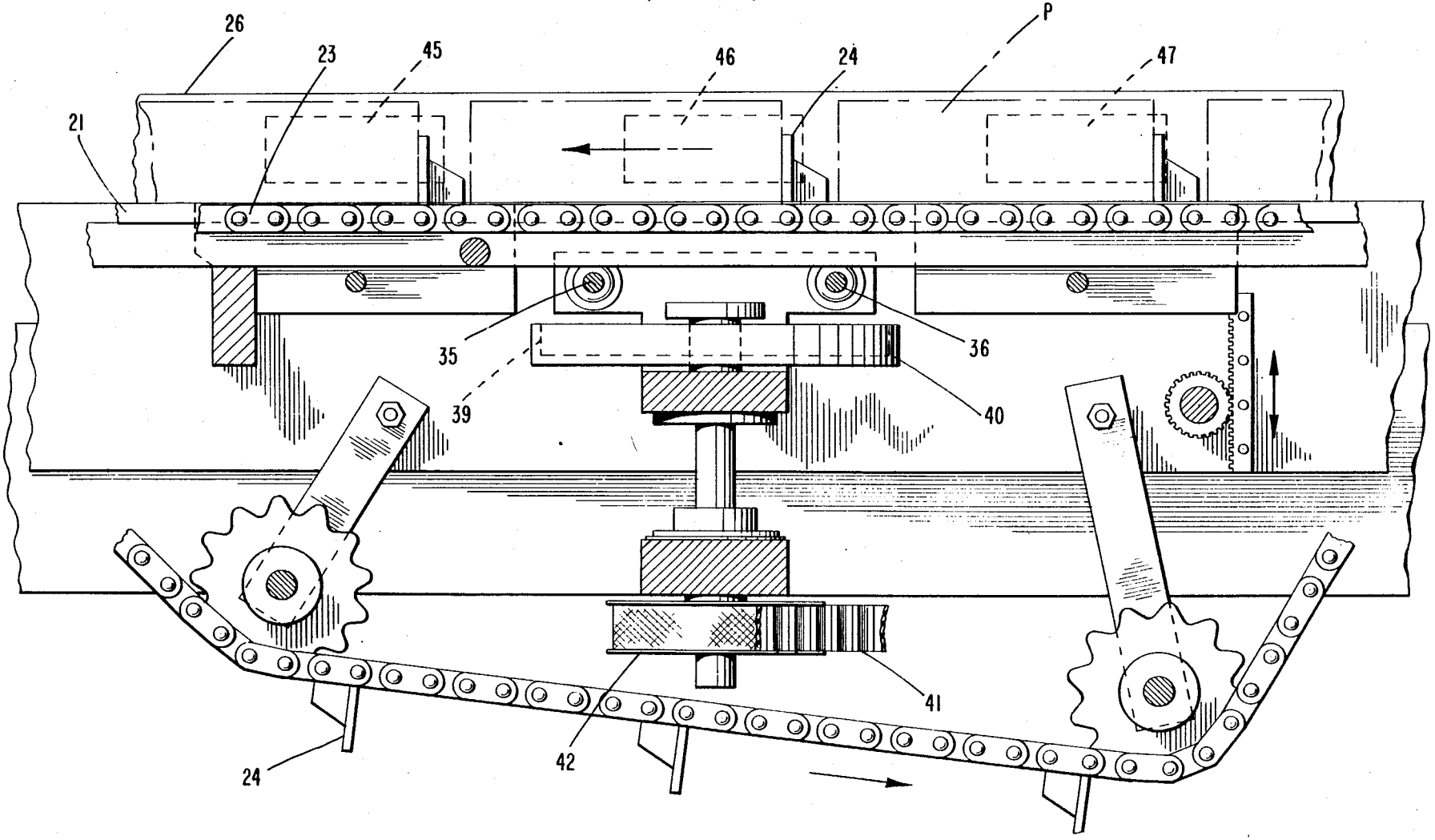
FIG. 6 is an enlarged, fragmentary sectional view of the apparatus as shown in FIG. 5.

Further, as shown schematically in FIG. 6, slightly raised areas or shaped projections 45, 46 and 47 are located on the fact of heater plates 26 and 27 to effect even greater localized pressure on the area being sealed. These projections 45, 46 and 47 are particularly helpful where the packages being wrapped are larger sized thereby providing more slack in the heat sealable material.

Sealing assembly 10 may be adjusted to accommodate packages of different size by turning hand crank 48 to operate screw-threaded slides 49 and 50 mounted to tracks 21 at opposite sides of assembly 10. Tracks 21 and its associated hardware move inwardly toward one another, or outwardly away from one another, depending upon which way crank 48 is turned. A further pair of screw-threaded slides 51 and 52 disposed at the ends of tracks 21 extend into transfer assembly 17. Slides 51 and 52 operate in conjunction with slides 49 and 50 by an interconnected drive means such as chain 53 and sprockets 54 and 55. Adjustment of the cam operated mechanism may be accomplished in a number of ways, as by substituting different cam wheels, or adjusting the mounting brackets 31 and 32 via clamping bolts 56, for example.

While the intermittently operated sealing assembly and method have been shown and described in detail, it is obvious that this invention is not to be considered as being limited to the exact form disclosed, and that changes in detail and construction may be made therein with the scope of the invention, without departing from the spirit thereof.

Having thus set forth and disclosed the nature of this invention, what is claimed is:

1. An assembly for sealing seams of heat sealable material on packages, said assembly comprising:

(a) package conveying means for supporting and intermittently moving packages along a path through a plurality of stationary work stations, (b) heat sealing means including heating means and at least one elongate heater plate movably supported along said path to contact a side of a plurality of packages being moved by the conveying means, said heater plate extending in a direction parallel to said path, (c) said heating means operatively associated with the heater plate along the length thereof to define a plurality of separate, successive heat sealing stations where one said side of each package is intermittently contacted a plurality of times, (d) said heater plate having a length which extends along said plurality of heat sealing stations which are at spaced locations along the heater plate, (e) drive means connected to move the heater plate into and out of simultaneous contact with said one side of a plurality of packages supported on the conveyor means when the conveyor means and packages are stationary and each package is disposed at a respective heat sealing station, (f) said simultaneous contact of the heater plate being sufficient to subject said one side of each package to a plurality of heat sealing steps as said each package moves successively through and dwell at the plurality of heat stations during operation of the assembly, (g) the elongate heater plate remains in sufficient proximity with each package to constantly apply heat to the package over the entire length of the heater plate as the package moves from one heat sealing station to the next.

2. An assembly as defined in claim 1 wherein the package conveying means includes a first intermittent heat sealing assembly disposed ahead of the heater plate for sealing a portion of the overwrap, and continuously moving transfer means for transferring packages from the first intermittent heat sealing assembly to said heat sealing means.

3. An assembly as defined in claim wherein the drive means comprises a cam member connected to reciprocate the heater plate into and out of the simultaneous contact with the plurality of packages disposed at said spaced heat sealing stations.

4. An assembly as defined in any one of claims 1, 2 or 3 wherein there is a pair of elongate heater plates laterally spaced with respect to each other on opposite sides of said path to simultaneously contact opposing sides of said plurality of packages disposed at said spaced heat sealing stations.

5. An assembly as defined in claim 1 wherein the heating means includes three separate heaters operatively associated with each heater plate on the side thereof opposite the packages thereby defining three separate, successive heat sealing stations.

6. An assembly as defined in any one of claims 1, 2 or 3 wherein the conveying means includes a pair of package supporting tracks extending alongside the heater plates and means connected to the conveying means for adjusting the width between the tracks to accommodate packages of different size in the assembly.

7. An assembly as defined in claim 6 wherein the adjusting means comprises a screw threaded operating member connected with a plurality of slides mounted on guide rods extending transversely of the supporting tracks.

8. An assembly as defined in claim 1 wherein there is a pair of elongate heater plates laterally spaced with respect to each other on opposite sides of said path to simultaneously contact opposing sides of said plurality of packages disposed at said spaced heat sealing stations, the drive means comprises a cam member connected to reciprocate the heater plates into and out of the simultaneous contact with the opposing sides of the plurality of packages, the cam member comprises a rotatable cam plate having a cam track in one face thereof, and the drive means includes a cam follower connected to cause the heater plates to reciprocate toward and away from each other as the cam plate rotates.

9. A method of heat sealing a heat sealable material on a package, said method comprising the steps of:

(a) applying a sheet of heat sealable material to a package and folding the sheet to define a seam along the package, (b) intermittently advancing the package along at least one movably supported elongated heater plate to dwell periodically at a plurality of stationary heat sealing stations which are at spaced locations along said heater plate where said seam is to be contacted a plurality of times, (c) contacting said seam of the package with pressure and heat by moving said heater plate into engagement with said package a plurality of heating contact times during dwell periods at successive said heat sealing stations to increase the contact time of application of heat to seal said seam of the package while reducing the temperature required to achieve sealing in a single application of heat, and (d) maintaining a heated condition between the heating contact times as the package is moved from one successive heat sealing station to the next.

* * * * *